US012680027B2

(12) United States Patent
Alroaithi et al.

(10) Patent No.: US 12,680,027 B2
(45) Date of Patent: Jul. 14, 2026

(54) PROCESSES FOR MAKING MESOPHASE PITCH

(71) Applicant: Saudi Arabian Oil Company, Dhahran (SA)

(72) Inventors: Mohammad Alroaithi, Thuwal (SA); Khalid Ali Almajnouni, Thuwal (SA); Ali Alharbi, Thuwal (SA)

(73) Assignee: Saudi Arabian Oil Company, Dhahran (SA)

( * ) Notice: Subject to any disclaimer, the term of this patent is extended or adjusted under 35 U.S.C. 154(b) by 184 days.

(21) Appl. No.: 18/658,072

(22) Filed: May 8, 2024

(65) Prior Publication Data

US 2025/0346815 A1 Nov. 13, 2025

(51) Int. Cl.
*C10C 3/02* (2006.01)
*C10C 3/00* (2006.01)

(52) U.S. Cl.
CPC ..... *C10C 3/026* (2013.01); *C10C 3/002* (2013.01)

(58) Field of Classification Search
CPC ..... C10C 3/026; C10C 3/002; D01F 9/155; C10G 2300/1096; C10G 9/02
See application file for complete search history.

(56) References Cited

U.S. PATENT DOCUMENTS 4,497,789 A 2/1985 Sawran et al.
4,518,483 A * 5/1985 Dickakian ..... C10C 3/002 208/22
7,153,452 B2 12/2006 Ogale et al.
7,846,543 B2 12/2010 Sano et al.
9,580,839 B2 2/2017 Bohnert et al.
10,508,240 B2 12/2019 Mahfouz et al.
10,913,901 B2 2/2021 Manfouz et al.
11,149,361 B1 10/2021 Liu et al.
11,434,429 B2 9/2022 Goodrich et al.
(Continued)

FOREIGN PATENT DOCUMENTS

CN 112708449 A 4/2021
EP 0246591 A1 * 11/1987 ..... C10C 1/18
WO 2018236832 A1 12/2018

OTHER PUBLICATIONS

Notification of Transmittal of the International Search Report and the Written Opinion of the International Searching Authority, or the Declaration dated Aug. 4, 2025 pertaining to International application No. PCT/US2025/027492 filed May 2, 2025, pp. 1-20.
(Continued)

*Primary Examiner* — Randy Boyer
*Assistant Examiner* — Juan C Valencia
(74) *Attorney, Agent, or Firm* — Dinsmore & Shohl LLP

(57) ABSTRACT

A process for making a mesophase pitch may include passing an aromatics-rich feed into a reactor and subjecting the aromatics-rich feed to a temperature of greater than or equal to 350° C. and a pressure of from 20 bar to 40 bar for a duration of from 4 hours to 10 hours in the reactor to produce the mesophase pitch. The total amount of molecular oxygen and peroxides in the reactor may be less than 1 mol. %. The aromatics-rich feed may include at least 80 wt. % aromatics and the aromatics-rich feed may include less than 3 wt. % of a combination of sulfur, nitrogen, and oxygen.

21 Claims, 1 Drawing Sheet

(56) References Cited

U.S. PATENT DOCUMENTS

2018/0362855 A1* 12/2018 Mahfouz ..... C10C 3/00
2020/0299589 A1 9/2020 Atkins et al.

OTHER PUBLICATIONS

Li, Ming et al. "Preparation and characterization of petroleum-based mesophase pitch by thermal condensation with in-process hydrogenation", RSC Advances, vol. 8, No. 53, Jan. 1, 2018, pp. 30230-30238.
Li, Ming et al. "Effects of Inductive Condensation on Mesophase Development during Aromatic-Rich Oil Carbonization", Energy & Fuels, vol. 33, No. 8, Jul. 2, 2019, pp. 7200-7205.
Lou, Bin et al. "Modified effect on properties of mesophase pitch prepared from various two-stage thermotreatments of FCC decant oil", Fuel, IPC Sience and Technology Press, Guildford, GB, vol. 284, Aug. 26, 2020, pp. 1-12.
Yu, Tao et al. "Structure and composition of mesophase pitch prepared from aromatic-rich fluid catalytic cracking slurry under different process conditions", Asia-Pacific Journal of Chemical Engineering, John Wiley & Sons Ltd, US, vol. 19, No. 5, Jun. 7, 2024, pp. 1-13.
Wang, Mingzhi et al. "Synthesis of Mesophase Pitch from Aromatic-Rich Fluid Catalytic Cracking Slurry: Key Advantages", Petroleum Chemistry, Pleiades Publishing, Moscow, vol. 65, No. 2, Feb. 1, 2025, pp. 190-205.
Li et al., "Preparation of mesophase pitch by aromatics-rich distillate of naphthenic vacuum gas oil", Appl Petrochem Res, vol. 5, pp. 339-346, 2015.
Supramono et al., "Polymerization of deasphalted vacuum residue mixed with gum rosin for mesophase pitch production", AIP Conference Proceedings 2061, 020050, 2019.
Wamg et al., "Research progress in the preparation of mesophase pitch from fluid catalytic cracking slurry", Royal Society of Chemistry, vol. 13, pp. 18676-18689, 2023.

* cited by examiner

PROCESSES FOR MAKING MESOPHASE PITCH

TECHNICAL FIELD

Embodiments of the present disclosure generally relate to chemical processing and, more specifically, to making pitch.

BACKGROUND

Pitch is a general class of materials that are carbonaceous, tacky residues that can result from distillation of coal tar, petroleum, pine tar, and fatty acids. Some pitch is classified as mesophase pitch, meaning that the pitch may be in a phase of matter intermediate between solid and liquid at room temperature. Mesophase pitch is a valuable precursor to advanced carbon materials, such as carbon fibers, foam, needle coke, and graphene.

Conventionally, mesophase pitch can be formed by processing crude oil, crude oil residues, or coal tar pitch.

SUMMARY

Conventional processes for making mesophase pitch may result in relatively high levels of heteroatoms, including sulfur, nitrogen, and oxygen. These heteroatoms may negatively affect the formation of the mesophase structure during the preparation of mesophase pitch and result in low quality mesophase pitch having less usefulness in, for example, making carbon fibers. Described herein are new methods for making mesophase pitch that may result in relatively low levels of heteroatoms and thus, improve mesophase quality, according to some embodiments. In particular, it has been found that processes that utilize aromatics-rich feeds with at least 80 wt. % aromatics and relatively small amounts of sulfur, nitrogen, and/or oxygen can produce mesophase pitch with relatively high quality mesophase structure. The aromatics-rich feed may be an off stream from other refinery processes, for example, a cycle oil from a fluid catalytic cracking system. The aromatics-rich feeds may be subjected to temperatures of greater than or equal to 350° C. at specific pressures and durations of time in a reactor to produce a high-quality mesophase pitch that has low amounts of heteroatoms. Additionally, unlike some conventional embodiments, the environment in the reactor may contain only small amounts of molecular oxygen and/or peroxides, which can decrease production costs and limit risk of explosion when subjecting the aromatics-rich feed to sufficient temperatures and pressures to produce the mesophase pitch. The mesophase pitch produced from these aromatics-rich feeds may be ideal as a precursor to advanced carbon materials.

According to one or more embodiments described herein, a process for making a mesophase pitch may comprise passing an aromatics-rich feed into a reactor, and subjecting the aromatics-rich feed to a temperature of greater than or equal to 350° C. and a pressure of from 20 bar to 40 bar for a duration of from 4 hours to 10 hours in the reactor to produce the mesophase pitch. The total amount of molecular oxygen and peroxides in the reactor may be less than 1 mol. %. The aromatics-rich feed may comprise at least 80 wt. % aromatics, and the aromatics-rich feed may comprise less than 3 wt. % of a combination of sulfur, nitrogen, and oxygen.

These and other embodiments are described in more detail in the Detailed Description. It is to be understood that both the foregoing general description and the following detailed description present embodiments of the subject technology, and are intended to provide an overview or framework for understanding the nature and character of the described technology as it is claimed.

BRIEF DESCRIPTION OF THE DRAWINGS

The following detailed description of specific embodiments of the present disclosure can be best understood when read in conjunction with the following drawings, where the structure is indicated with like reference numerals and in which.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Embodiments of the present disclosure relate to processes for making mesophase pitch. As is described herein, according to embodiments, the process for making the mesophase pitch may include at least passing an aromatics-rich feed into a reactor, and subjecting the aromatics-rich feed to a temperature and pressure sufficient to produce the mesophase pitch.

In general, pitch includes polycyclic aromatic hydrocarbons and is commonly divided into two classes: isotropic pitch and mesophase pitch. Mesophase pitch may also be known in the industry as anisotropic pitch. Isotropic pitch and mesophase pitch have different molecular orientations which affects the properties of the pitch. Isotropic pitch generally is formed of a random orientation of the polycyclic aromatic hydrocarbon molecules, whereas mesophase pitch may be formed of a large variety of organized polycyclic aromatic hydrocarbons with a maintained molecular ordering. Moreover, without being bound by any particular theory, it is believed that utilizing isotropic pitch as a precursor to carbon fibers will result in general purpose fibers with low strength and stiffness. On the other hand, it is believed that mesophase pitch will result in stronger and stiffer carbon fibers. Conventionally, carbon fibers are produced through the use of acrylonitrile as a feedstock which can be expensive. In one or more embodiments, the mesophase pitch formed from the processes described herein may be further processed to make carbon fibers. Without being bound by any particular theory, it is believed that the manufacturing cost of carbon fibers may be reduced through using the processes as described herein.

Figure 1:
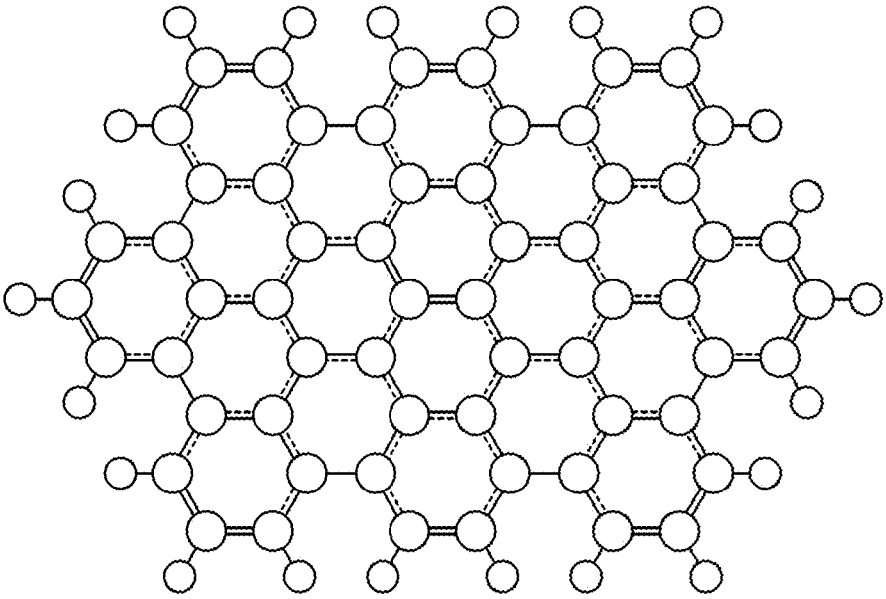
FIG. 1 schematically depicts a structure of a mesophase molecule of a mesophase pitch, according to one or more embodiments described in this disclosure.
Figure 2:
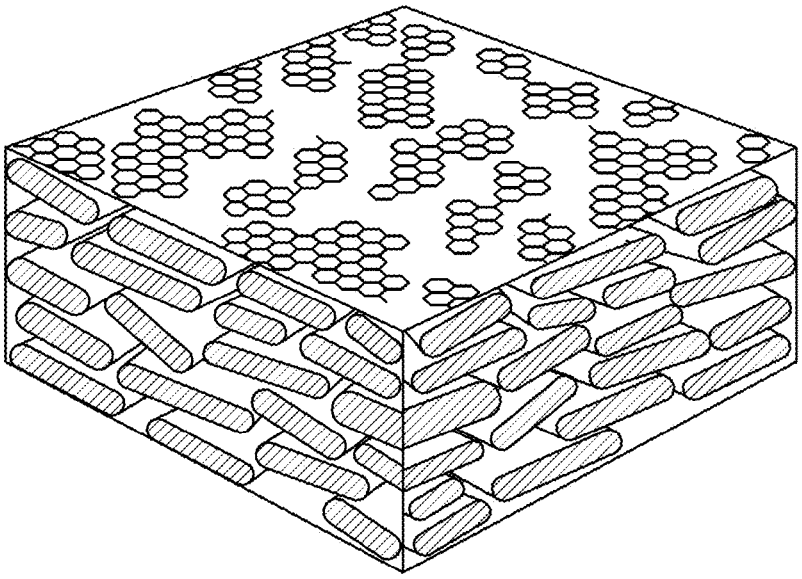
FIG. 2 schematically depicts a model three-dimensional network structure of mesophase pitch, according to one or more embodiments described in this disclosure.

Referring to FIG. 1, a structure of a polycyclic aromatic hydrocarbon molecule is depicted. In general, mesophase pitch may be formed of a large variety of organized polycyclic aromatic hydrocarbons with a maintained molecular ordering. Additionally, referring now to FIG. 2, a model three-dimensional network structure of mesophase pitch is depicted. The polycyclic aromatic hydrocarbon units may be large and stack to form liquid crystalline structured domains, as shown in FIG. 2.

According to one or more embodiments, a process for making a mesophase pitch may comprise passing an aromatics-rich feed into a reactor. As used in this disclosure, a "reactor" may refer to any vessel in which one or more chemical reactions occur between one or more reactants. For example, a reactor may include a tank or tubular reactor configured to operate as a batch reactor. In some embodiments, the reactor may be a batch reactor. In some embodiments, the reactor may be equipped with a reactor jacket.

In one or more embodiments, the aromatics-rich feed may comprise at least 80 wt. % aromatics. As used in this disclosure, "aromatics" refers to compounds that contain one or more aromatic rings. Without limitation, aromatics may include naphthalenes, acenaphthenes, acenaphthylenes, fluorenes, phenanthres, anthracenes, pyrenes, tetra-aromatics, and penta-aromatics. In some embodiments, the aromatics-rich feed may comprise at least 81 wt. % aromatics, at least 82 wt. % aromatics, at least 83 wt. % aromatics, at least 84 wt. % aromatics, at least 85 wt. % aromatics, at least 86 wt. % aromatics, at least 87 wt. % aromatics, at least 88 wt. % aromatics, at least 89 wt. % aromatics, at least 90 wt. % aromatics, at least 91 wt. % aromatics, at least 92 wt. % aromatics, at least 93 wt. % aromatics, at least 94 wt. % aromatics, at least 95 wt. % aromatics, at least 96 wt. % aromatics, at least 97 wt. % aromatics, at least 98 wt. % aromatics, or even at least 99 wt. % aromatics. The aromatics-rich feed may comprise from 80 wt. % to 82 wt. % aromatics, from 82 wt. % to 84 wt. % aromatics, 84 wt. % to 86 wt. % aromatics, from 86 wt. % to 88 wt. % aromatics, 88 wt. % to 90 wt. % aromatics, from 90 wt. % to 92 wt. % aromatics, from 92 wt. % to 94 wt. % aromatics, from 94 wt. % to 96 wt. % aromatics, from 96 wt. % to 98 wt. % aromatics, from 98 wt. % to 99 wt. % aromatics, or any combinations of these ranges. In some embodiments, the aromatics-rich feed may comprise from 80 wt. % to 95 wt. % aromatics, from 82 wt. % to 92 wt. % aromatics, from 85 wt. % to 90 wt. % aromatics, or any combinations of these ranges. In additional embodiments, the amount of one or more of naphthalenes, acenaphthenes, acenaphthylenes, fluorenes, phenanthres, anthracenes, pyrenes, tetra-aromatics, and penta-aromatics may be in any of the ranges listed immediately above. Without being bound by any particular theory, it is believed that utilizing a feed comprising at least 80 wt. % aromatics results in a mesophase pitch with high amounts of organized polycyclic aromatic hydrocarbons. It is contemplated that utilizing a feed comprising less than 80 wt. % aromatics will not adequately form mesophase pitch due to insufficient amounts of aromatics condensing to form mesophase pitch.

In one or more embodiments, the aromatics-rich feed may comprise from 1 wt. % to 10 wt. % saturates. As used in this disclosure, "saturates" refers to nonpolar compounds including linear, branched, and cyclic saturated hydrocarbons. Without limitation, saturates may include alkanes, alkyls, and cycloparaffins. In some embodiments, the aromatics-rich feed may comprise from 1 wt. % to 2 wt. % saturates, from 2 wt. % to 3 wt. % saturates, from 3 wt. % to 4 wt. % saturates, from 4 wt. % to 5 wt. % saturates, from 5 wt. % to 6 wt. % saturates, from 6 wt. % to 7 wt. % saturates, from 7 wt. % to 8 wt. % saturates, from 8 wt. % to 9 wt. % saturates, from 9 wt. % to 10 wt. % saturates, or any combinations of these ranges. For example, the aromatics-rich feed may comprise less than or equal to 10 wt. % saturates and at least 2 wt. % saturates, at least 3 wt. % saturates, at least 4 wt. % saturates, at least 5 wt. % saturates, at least 6 wt. % saturates, at least 7 wt. % saturates, at least 8 wt. % saturates, or at least 9 wt. % saturates. In some embodiments, the aromatics-rich feed may comprise at least 1 wt. % saturates and less than or equal to 9 wt. % saturates, less than or equal to 8 wt. % saturates, less than or equal to 7 wt. % saturates, less than or equal to 6 wt. % saturates, less than or equal to 5 wt. % saturates, less than or equal to 4 wt. % saturates, less than or equal to 3 wt. % saturates, or less than or equal to 2 wt. % saturates. Without being bound by any particular theory, it is believed that aromatics-rich feeds with greater than 10 wt. % saturates in processes described herein may cause cracking of the aromatics-rich feed rather than polycondensation of the heavy polycyclic aromatics and formation of mesophase pitch.

In one or more embodiments, the aromatics-rich feed may comprise less than 5 wt. % resins. As used in this disclosure, "resins" refers to components that are soluble in heptane and pentane but do not dissolve in acetone or ethyl acetate. In some embodiments, the aromatics-rich feed may comprise less than 4.5 wt. %, less than 4 wt. %, less than 3.5 wt. %, less than 3 wt. %, less than 2.5 wt. %, less than 2 wt. %, less than 1 wt. %, or even less than 0.5 wt. % resins. In some embodiments, the aromatics-rich feed may comprise from 0 wt. % to 0.5 wt. % resins, from 0.5 wt. % to 1 wt. % resins, from 1 wt. % to 1.5 wt. % resins, from 1.5 wt. % to 2 wt. % resins, from 2 wt. % to 2.5 wt. % resins, from 2.5 wt. % to 3 wt. % resins, from 3 wt. % to 3.5 wt. % resins, from 3.5 wt. % to 4 wt. % resins, from 4 wt. % to 4.5 wt. % resins, from 4.5 wt. % to 5 wt. % resins, or any combinations of these ranges. In some embodiments, the aromatics-rich feed may comprise less than 0.2 wt. % resins, less than 0.1 wt. % resins, or 0 wt. % resins.

In one or more embodiments, the aromatics-rich feed may comprise from 0 wt. % to 1 wt. % asphaltenes. As used in this disclosure, "asphaltenes" refers to components that dissolve in aromatic solvents and precipitate in normal alkanes. Without limitation, asphaltenes may be nonpolar and nonvolatile, and may comprise carbon, hydrogen, nitrogen, sulfur, oxygen, nickel and vanadium. In some embodiments, the aromatics-rich feed may comprise less than 1 wt. % asphaltenes, less than 0.9 wt. % asphaltenes, less than 0.8 wt. % asphaltenes, less than 0.7 wt. % asphaltenes, less than 0.6 wt. % asphaltenes, less than 0.5 wt. % asphaltenes, less than 0.4 wt. % asphaltenes, less than 0.3 wt. % asphaltenes, less than 0.2 wt. % asphaltenes, or even less than 0.1 wt. % asphaltenes. In some embodiments, the aromatics-rich feed may comprise from 0 wt. % to 0.1 wt. % asphaltenes, from 0.1 wt. % to 0.2 wt. % asphaltenes, from 0.2 wt. % to 0.3 wt. % asphaltenes, from 0.3 wt. % to 0.4 wt. % asphaltenes, from 0.4 wt. % to 0.5 wt. % asphaltenes, from 0.5 wt. % to 0.6 wt. % asphaltenes, from 0.6 wt. % to 0.7 wt. % asphaltenes, from 0.7 wt. % to 0.8 wt. % asphaltenes, from 0.8 wt. % to 0.9 wt. % asphaltenes, from 0.9 wt. % to 1 wt. % asphaltenes, or any combinations of these ranges. In some embodiments, the aromatics-rich feed may comprise 0 wt. % asphaltenes. Without being bound by any particular theory, it is believed that utilizing an aromatics-rich feed that comprises greater than 1 wt. % asphaltenes may cause formation of coke in the reactor during the reaction. Coke buildup is generally undesired and may reduce reaction efficiency and cause equipment fouling.

In one or more embodiments, the aromatics-rich feed may comprise or consist of cycle oil from a fluid catalytic cracking system. The aromatics-rich feed may be a light cycle oil or a heavy cycle oil. In one or more embodiments, the aromatics-rich feed may be a cycle oil that comprises from 3 wt. % to 7 wt. % saturates, from 90 wt. % to 95 wt. % aromatics, from 0 wt. % to 3 wt. % resins, and from 0 wt. % to 1 wt. % asphaltenes. In some embodiments, the aromatics-rich feed may be a cycle oil that comprises from 4 wt. % to 6 wt. % saturates, from 92 wt. % to 95 wt. % aromatics, from 0 wt. % to 2 wt. % resins, and from 0 wt. % to 0.1 wt. % asphaltenes.

According to one or more embodiments, the aromatics-rich feed may comprise from 85 wt. % to 95 wt. % carbon. In some embodiments, the aromatics-rich feed may comprise from 85 wt. % to 86 wt. % carbon, from 86 wt. % to 87 wt. % carbon, from 87 wt. % to 88 wt. % carbon, from 88 wt. % to 89 wt. % carbon, from 89 wt. % to 90 wt. % carbon, from 90 wt. % to 91 wt. % carbon, from 91 wt. % to 92 wt. % carbon, from 92 wt. % to 93 wt. % carbon, from 93 wt. % to 94 wt. % carbon, from 94 wt. % to 95 wt. % carbon, or any combination of these ranges. In some embodiments, the aromatics-rich feed may comprise less than or equal to 95 wt. % carbon and at least 85 wt. % carbon, at least 86 wt. % carbon, at least 87 wt. % carbon, at least 88 wt. % carbon, at least 89 wt. % carbon, at least 90 wt. % carbon, at least 91 wt. % carbon, at least 92 wt. % carbon, at least 93 wt. % carbon, or at least 94 wt. % carbon. In some embodiments, the aromatics-rich feed may comprise at least 85 wt. % carbon and less than or equal to 94 wt. % carbon, less than or equal to 93 wt. % carbon, less than or equal to 92 wt. % carbon, less than or equal to 91 wt. % carbon, less than or equal to 90 wt. % carbon, less than or equal to 89 wt. % carbon, less than or equal to 88 wt. % carbon, less than or equal to 87 wt. % carbon, or less than or equal to 86 wt. % carbon.

According to one or more embodiments, the aromatics-rich feed may comprise from 5 wt. % to 15 wt. % hydrogen. In some embodiments, the aromatics-rich feed may comprise from 5 wt. % to 6 wt. % hydrogen, from 6 wt. % to 7 wt. % hydrogen, from 7 wt. % to 8 wt. % hydrogen, from 8 wt. % to 9 wt. % hydrogen, from 9 wt. % to 10 wt. % hydrogen, from 10 wt. % to 11 wt. % hydrogen, from 11 wt. % to 12 wt. % hydrogen, from 12 wt. % to 13 wt. % hydrogen, from 13 wt. % to 14 wt. % hydrogen, from 14 wt. % to 15 wt. % hydrogen, or any combination of these ranges. In some embodiments, the aromatics-rich feed may comprise less than or equal to 15 wt. % hydrogen and at least 6 wt. % hydrogen, at least 7 wt. % hydrogen, at least 8 wt. % hydrogen, at least 9 wt. % hydrogen, at least 10 wt. % hydrogen, at least 11 wt. % hydrogen, at least 12 wt. % hydrogen, at least 13 wt. % hydrogen, or at least 14 wt. % hydrogen. In some embodiments, the aromatics-rich feed may comprise at least 5 wt. % hydrogen and less than or equal to 14 wt. % hydrogen, less than or equal to 13 wt. % hydrogen, less than or equal to 12 wt. % hydrogen, less than or equal to 11 wt. % hydrogen, less than or equal to 10 wt. % hydrogen, less than or equal to 9 wt. % hydrogen, less than or equal to 8 wt. % hydrogen, less than or equal to 7 wt. % hydrogen, or less than or equal to 6 wt. % hydrogen.

Additionally, in one or more embodiments, the aromatics-rich feed may comprise less than 3 wt. % of a combination of sulfur, nitrogen, and oxygen. For example, and in some embodiments, the aromatics-rich feed may comprise less than 2.8 wt. %, less than 2.6 wt. %, less than 2.4 wt. %, less than 2.2 wt. %, less than 2 wt. %, less than 1.8 wt. %, less than 1.6 wt. %, less than 1.4 wt. %, less than 1.2 wt. %, less than 1 wt. %, less than 0.8 wt. %, less than 0.6 wt. %, less than 0.4 wt. %, or even less than 0.2 wt. % of a combination of sulfur, nitrogen, and oxygen. In some embodiments, the aromatics-rich feed may comprise less than 1 wt. % sulfur, less than 0.9 wt. % sulfur, less than 0.8 wt. % sulfur, less than 0.7 wt. % sulfur, less than 0.6 wt. % sulfur, less than 0.5 wt. % sulfur, less than 0.4 wt. % sulfur, less than 0.3 wt. % sulfur, less than 0.2 wt. % sulfur, or even less than 0.1 wt. % sulfur. In some embodiments, the aromatics-rich feed may comprise less than 1 wt. % nitrogen, less than 0.9 wt. % nitrogen, less than 0.8 wt. % nitrogen, less than 0.7 wt. % nitrogen, less than 0.6 wt. % nitrogen, less than 0.5 wt. % nitrogen, less than 0.4 wt. % nitrogen, less than 0.3 wt. % nitrogen, less than 0.2 wt. % nitrogen, or even less than 0.1 wt. % nitrogen. In some embodiments, the aromatics-rich feed may comprise less than 1 wt. % oxygen, less than 0.9 wt. % oxygen, less than 0.8 wt. % oxygen, less than 0.7 wt. % oxygen, less than 0.6 wt. % oxygen, less than 0.5 wt. % oxygen, less than 0.4 wt. % oxygen, less than 0.3 wt. % oxygen, less than 0.2 wt. % oxygen, or even less than 0.1 wt. % oxygen. Without being bound by any particular theory, it is believed that heteroatoms, such as sulfur, nitrogen, and oxygen, contaminate the mesophase pitch and negatively affect the formation of the mesophase structure during the process described herein. Additionally, it is believed that utilizing aromatics-rich feeds with less than 3 wt. % of a combination of sulfur, nitrogen, oxygen or combinations thereof results in mesophase pitch that is able to be melt-spun into carbon fibers.

In one or more embodiments, the hydrogen-to-carbon ratio of the aromatics-rich feed may be greater than 1. For example, in some embodiments, the hydrogen-to-carbon ratio of the aromatics-rich feed may be greater than 1.1, greater than 1.2, greater than 1.3, greater than 1.4, or even greater than 1.5. In some embodiments, the hydrogen-to-carbon ratio of the aromatics-rich feed may be from 1 to 1.5, from 1.1 to 1.4, from 1.2 to 1.3, or any combinations of these ranges.

According to one or more embodiments, the total amount of molecular oxygen (that is, $O_2$) and peroxides in the reactor may be less than 1 mol. %. Contemplated peroxides may include, without limitation, benzoyl peroxide or hydrogen peroxide. For example, and in some embodiments, the total amount of molecular oxygen and peroxides in the reactor may be less than 0.9 mol. %, less than 0.8 mol. %, less than 0.7 mol. %, less than 0.6 mol. %, less than 0.5 mol. %, less than 0.4 mol. %, less than 0.3 mol. %, less than 0.2 mol. %, or even less than 0.1 mol. %. In some embodiments, total amount of molecular oxygen and peroxides in the reactor may be 0 mol. %. Without being bound by any particular theory, it is believed that the presence of oxygen or peroxides in the reactor may cause commercially unsafe environments due to risk of explosion. Moreover, it is contemplated that the presently disclosed embodiments may operate without need for oxygen or peroxides which may add cost and/or complication to the process, which is generally undesirable in industry. On the other hand, some conventional process utilize relatively high oxygen and/or peroxide concentrations in order to produce pitch. Thus, it is believed that the presence of oxygen or peroxides is not required in the process when utilizing aromatics-rich feeds in the process described herein.

According to one or more embodiments, the process may comprise subjecting the aromatics-rich feed to a temperature of greater than or equal to 350° C. and a pressure of from 20 bar to 40 bar for a duration of from 4 hours to 10 hours in the reactor to produce the mesophase pitch. In some embodiments, the duration may be from 4 hours to 5 hours, from 5 hours to 6 hours, from 6 hours to 7 hours, from 7 hours to 8 hours, from 8 hours to 9 hours, from 9 hours to 10 hours, or any combinations of these ranges, such as from 4 hours to 8 hours, from 6 hours to 8 hours, from 6 hours to 10 hours, or from 5 hours to 7 hours. In some embodiments, the duration may be at least 4 hours and less than or equal to 9 hours, less than or equal to 8 hours, less than or equal to 7 hours, less than or equal to 6 hours, or less than or equal to 5 hours. In some embodiments, the duration may be less than or equal to 10 hours and at least 5 hours, at least 6 hours, at least 7 hours, at least 8 hours, or at least 9 hours.

In one or more embodiments, the aromatics-rich feed may be subjected to a temperature of greater than or equal to 350° C. in the reactor. In some embodiments, subjecting the aromatics-rich feed to the temperature of greater than or equal to 350° C. polymerizes the aromatics-rich feed in the reactor. In some embodiments, the temperature may be greater than or equal to 355° C., greater than or equal to 360° C., greater than or equal to 365° C., greater than or equal to 370° C., greater than or equal to 375° C., greater than or equal to 380° C., greater than or equal to 385° C., greater than or equal to 390° C., greater than or equal to 495° C., greater than or equal to 400° C., greater than or equal to 405° C., greater than or equal to 410° C., greater than or equal to 415° C., greater than or equal to 420° C., greater than or equal to 425° C., greater than or equal to 430° C., greater than or equal to 435° C., greater than or equal to 440° C., greater than or equal to 445° C., greater than or equal to 450° C., greater than or equal to 455° C., greater than or equal to 460° C., greater than or equal to 465° C., greater than or equal to 470° C., greater than or equal to 475° C., greater than or equal to 480° C., greater than or equal to 485° C., greater than or equal to 490° C., greater than or equal to 495° C., or even greater than or equal to 500° C.

Without being bound by any particular theory, it is believed that subjecting the aromatics-rich feed to a temperature of less than 350° C. will not result in the formation of the mesophase structure, as shown in FIG. 2. Temperatures greater than or equal to 350° C. are believed to allow for the side chains in the aromatics rings to crack and condense during the reaction and form the polycyclic aromatic hydrocarbons, as shown in FIG. 1.

In one or more embodiments, the aromatics-rich feed may be subjected to a pressure of from 20 bar to 40 bar in the reactor. In some embodiments, the aromatics-rich feed may be subjected to a pressure of from 20 bar to 22 bar, from 22 bar to 24 bar, from 24 bar to 26 bar, from 26 bar to 28 bar, from 28 bar to 30 bar, from 30 bar to 32 bar, from 32 bar to 34 bar, from 34 bar to 36 bar, from 36 bar to 38 bar, from 38 bar to 40 bar, or any combinations of these ranges in the reactor. In some embodiments, the aromatics-rich feed may be subjected to a pressure of at least 20 bar and less than or equal to 38 bar, less than or equal to 36 bar, less than or equal to 34 bar, less than or equal to 32 bar, less than or equal to 30 bar, less than or equal to 28 bar, less than or equal to 26 bar, less than or equal to 24 bar, or less than or equal to 22 bar. In some embodiments, the aromatics-rich feed may be subjected to a pressure of less than or equal to 40 bar and at least 22 bar, at least 24 bar, at least 26 bar, at least 28 bar, at least 30 bar, at least 32 bar, at least 34 bar, at least 36 bar, or at least 38 bar.

According to one or more embodiments, the aromatics-rich feed may be stirred in the reactor. In some embodiments, stirring is continuous throughout the duration of the process. In one or more embodiments, the aromatics-rich feed may be synthesized to form mesophase pitch without, or in the absence of, any pretreatment. It is believed that the temperatures and pressures in the reactor for the durations described herein lead to a one-step process for the conversion of the aromatics-rich feed into mesophase pitch without the need for pretreatment.

In one or more embodiments, the reactor may be purged with an inert gas prior to passing the aromatics-rich feed to the reactor. In some embodiments, the inert gas may be nitrogen, argon, or helium. In some embodiments, the inert gas may be used to maintain the desired pressure in the reactor and/or may regulate the amount of molecular oxygen in the reactor.

Referring now to the mesophase pitch that is formed, according to one or more embodiments, the mesophase pitch may comprise at least 10 wt. % resins. In some embodiments, the mesophase pitch may comprise at least 11 wt. % resins, at least 12 wt. % resins, at least 13 wt. % resins, at least 14 wt. % resins, at least 15 wt. % resins, at least 16 wt. % resins, at least 17 wt. % resins, at least 18 wt. % resins, at least 19 wt. % resins, or even at least 20 wt. % resins. In some embodiments, the mesophase pitch may comprise from 10 wt. % to 20 wt. % resins. For example, the mesophase pitch may comprise from 10 wt. % to 12 wt. % resins, from 12 wt. % to 14 wt. % resins, from 14 wt. % to 16 wt. % resins, from 16 wt. % to 18 wt. % resins, from 18 wt. % to 20 wt. % resins, or any combinations of these ranges. Without being bound by any particular theory, it is contemplated that the viscosity of the mesophase pitch depends directly on the percentage of the resins, and the relationship between viscosity and resin concentration may be exponential.

According to one or more embodiments, the mesophase pitch may comprise from 10 wt. % to 20 wt. % asphaltenes. In some embodiments, the mesophase pitch may comprise from 10 wt. % to 11 wt. % asphaltenes, from 11 wt. % to 12 wt. % asphaltenes, from 12 wt. % to 13 wt. % asphaltenes, 13 wt. % to 14 wt. % asphaltenes, from 14 wt. % to 15 wt. % asphaltenes, from 15 wt. % to 16 wt. % asphaltenes, from 16 wt. % to 17 wt. % asphaltenes, from 17 wt. % to 18 wt. % asphaltenes, from 18 wt. % to 19 wt. % asphaltenes, from 19 wt. % to 20 wt. % asphaltenes, or any combinations of these ranges, such as from 12 wt. % to 18 wt. % resins. Without being bound by any particular theory, it is believed that the viscosity of the mesophase pitch depends directly on the percentage of the asphaltenes, and the relationship between viscosity and asphaltene concentration may be exponential.

According to one or more embodiments, the mesophase pitch may comprise from 65 wt. % to 75 wt. % aromatics. In some embodiments, the mesophase pitch may comprise from 65 wt. % to 66 wt. % aromatics, from 66 wt. % to 67 wt. % aromatics, from 67 wt. % to 68 wt. % aromatics, from 68 wt. % to 69 wt. % aromatics, from 69 wt. % to 70 wt. % aromatics, from 70 wt. % to 71 wt. % aromatics, from 71 wt. % to 72 wt. % aromatics, from 72 wt. % to 73 wt. % aromatics, from 73 wt. % aromatics to 74 wt. % aromatics, from 74 wt. % to 75 wt. % aromatics, or any combinations of these ranges. In some embodiments, the mesophase pitch may comprise at least 65 wt. % aromatics and less than or equal to 74 wt. % aromatics, less than or equal to 73 wt. % aromatics, less than or equal to 72 wt. % aromatics, less than or equal to 71 wt. % aromatics, less than or equal to 70 wt. % aromatics, less than or equal to 69 wt. % aromatics, less than or equal to 68 wt. % aromatics, less than or equal to 67 wt. % aromatics, or less than or equal to 66 wt. % aromatics. In some embodiments, the mesophase pitch may comprise less than or equal to 75 wt. % and at least 66 wt. % aromatics, at least 67 wt. % aromatics, at least 68 wt. % aromatics, at least 69 wt. % aromatics, at least 70 wt. % aromatics, at least 71 wt. % aromatics, at least 72 wt. % aromatics, at least 73 wt. % aromatics, or at least 74 wt. % aromatics. Without being bound by any particular theory, it is believed that the aromatic compounds in the aromatics-rich feed are polymerized in the reactor to form resins and asphaltenes, thereby increasing the viscosity and forming mesophase pitch.

According to one or more embodiments, the mesophase pitch may comprise from 0 wt. % to 1 wt. % saturates. In some embodiments, the mesophase pitch may comprise from 0 wt. % to 0.1 wt. % saturates, from 0.1 wt. % to 0.2 wt. % saturates, from 0.2 wt. % to 0.3 wt. % saturates, from 0.3 wt. % to 0.4 wt. % saturates, from 0.4 wt. % to 0.5 wt. % saturates, from 0.5 wt. % to 0.6 wt. % saturates, from 0.6 wt. % to 0.7 wt. % saturates, from 0.7 wt. % to 0.8 wt. % saturates, from 0.8 wt. % to 0.9 wt. % saturates, from 0.9 wt. % to 1 wt. % saturates, or any combinations of these ranges. In some embodiments, the mesophase pitch may comprise less than 1 wt. % saturates, less than 0.9 wt. % saturates, less than 0.8 wt. % saturates, less than 0.7 wt. % saturates, less than 0.6 wt. % saturates, less than 0.5 wt. % saturates, less than 0.4 wt. % saturates, less than 0.3 wt. % saturates, less than 0.2 wt. % saturates, or less than 0.1 wt. % saturates. In some embodiments, the mesophase pitch may comprise 0 wt. % saturates. Without being bound by any particular theory, the saturates in the aromatics-rich feed may crack during the reaction and form gases, such as hydrogen. The hydrogen may fuel the reaction and improve the efficiency and economics of the process.

In one or more embodiments, the mesophase pitch may comprise from 20 wt. % to 45 wt. % solids. As used in this disclosure, "solids" may refer to the amount of mesophase pitch that is in a solid state of matter. In some embodiments, the mesophase pitch may comprise solids in an amount of from 22 wt. % to 42 wt. %, from 25 wt. % to 40 wt. %, from 26 wt. % to 38 wt. %, from 28 wt. % to 36 wt. %, from 30 wt. % to 34 wt. %, or any combinations of these ranges. In some embodiments, the mesophase pitch may comprise solids in an amount of at least 20 wt. % and less than or equal to 44 wt. %, less than or equal to 43 wt. %, less than or equal to 44 wt. %, less than or equal to 42 wt. %, less than or equal to 41 wt. %, less than or equal to 40 wt. %, less than or equal to 39 wt. %, less than or equal to 38 wt. %, less than or equal to 37 wt. %, less than or equal to 36 wt. %, less than or equal to 35 wt. %, less than or equal to 34 wt. %, less than or equal to 33 wt. %, less than or equal to 32 wt. %, less than or equal to 31 wt. %, less than or equal to 30 wt. %, less than or equal to 29 wt. %, less than or equal to 28 wt. %, less than or equal to 27 wt. %, less than or equal to 26 wt. %, less than or equal to 25 wt. %, less than or equal to 24 wt. %, less than or equal to 23 wt. %, less than or equal to 22 wt. %, or even less than or equal to 21 wt. %. In some embodiments, the solids content of the mesophase pitch may be less than or equal to 45 wt. % and at least 21 wt. %, at least 22 wt. %, at least 23 wt. %, at least 24 wt. %, at least 25 wt. %, at least 26 wt. %, at least 27 wt. %, at least 28 wt. %, at least 29 wt. %, at least 30 wt. %, at least 31 wt. %, at least 32 wt. %, at least 33 wt. %, at least 34 wt. %, at least 35 wt. %, at least 36 wt. %, at least 37 wt. %, at least 38 wt. %, at least 39 wt. %, at least 40 wt. %, at least 41 wt. %, at least 42 wt. %, at least 43 wt. %, or even at least 44 wt. %.

In one or more embodiments, the mesophase pitch may comprise from 1 wt. % to 5 wt. % gases. As used in this disclosure, "gases" may refer to the amount of mesophase pitch that is in a gaseous state of matter. For example, in some embodiments, the mesophase pitch may comprise gases in an amount from 1 wt. % to 2 wt. %, from 2 wt. % to 3 wt. %, from 4 wt. % to 5 wt. %, from 2 wt. % to 4 wt. %, from 1 wt. % to 3 wt. %, from 1 wt. % to 4 wt. %, from 2 wt. % to 5 wt. %, from 3 wt. % to 5 wt. %, or any combination of these ranges.

In one or more embodiments, the mesophase pitch may comprise from 50 wt. % to 80 wt. % liquids. As used in this disclosure, "liquids" may refer to the amount of mesophase pitch that is in a liquid state of matter. For example, in some embodiments, the mesophase pitch may comprise liquids in an amount of at least 50 wt. % and less than or equal to 78 wt. %, less than or equal to 76 wt. %, less than or equal to 74 wt. %, less than or equal to 72 wt. %, less than or equal to 70 wt. %, less than or equal to 68 wt. %, less than or equal to 66 wt. %, less than or equal to 64 wt. %, less than or equal to 62 wt. %, less than or equal to 60 wt. %, less than or equal to 58 wt. %, less than or equal to 56 wt. %, less than or equal to 54 wt. %, or even less than or equal to 52 wt. %. In some embodiments, the mesophase pitch may comprise liquids in an amount of less than or equal to 80 wt. % and at least 52 wt. %, at least 54 wt. %, at least 56 wt. %, at least 58 wt. %, at least 60 wt. %, at least 62 wt. %, at least 64 wt. %, at least 66 wt. %, at least 68 wt. %, at least 70 wt. %, at least 72 wt. %, at least 74 wt. %, at least 76 wt. %, or even at least 78 wt. %.

Without being bound by any particular theory, in some embodiments, the desired mesophase pitch is homogenous at room temperature, such that it is in a phase of matter intermediate between a solid and liquid at room temperature. In some embodiments, the softening point of the mesophase pitch may be from 150° C. to 350° C. For example, in some embodiments, the softening point of the mesophase pitch may be from 150° C. to 175° C., from 175° C. to 200° C., from 200° C. to 225° C., from 225° C. to 250° C., from 250° C. to 275° C., from 275° C. to 300° C., from 300° C. to 325° C., from 325° C. to 350° C., or any combinations of these ranges.

The present disclosure includes numerous aspects, including aspects 1-20 described herein.

Aspect 1. A process for making a mesophase pitch, the process comprising: passing an aromatics-rich feed into a reactor, wherein: the total amount of molecular oxygen and peroxides in the reactor is less than 1 mol. %; the aromatics-rich feed comprises at least 80 wt. % aromatics; the aromatics-rich feed comprises less than 3 wt. % of a combination of sulfur, nitrogen, and oxygen; and subjecting the aromatics-rich feed to a temperature of greater than or equal to 350° C. and a pressure of from 20 bar to 40 bar for a duration of from 4 hours to 10 hours in the reactor to produce the mesophase pitch.

Aspect 2. The process of aspect 1, wherein the aromatics-rich feed is subjected to a temperature of greater than or equal to 400° C.

Aspect 3. The process of any previous aspect, wherein the aromatics-rich feed is subjected to a temperature of greater than or equal to 450° C.

Aspect 4. The process of any previous aspect, wherein the aromatics-rich feed comprises a cycle oil from a fluid catalytic cracking system.

Aspect 5. The process of any previous aspect, wherein the mesophase pitch is made in a batch process.

Aspect 6. The process of any previous aspect, wherein the duration is from 5 to 7 hours.

Aspect 7. The process of any previous aspect, wherein: the aromatics-rich feed comprises less than 5 wt. % resins; and the mesophase pitch comprises at least 10 wt. % resins.

Aspect 8. The process of any previous aspect, wherein subjecting the aromatics-rich feed to the temperature of greater than or equal to 350° C. polymerizes the aromatics-rich feed in the reactor.

Aspect 9. The process of any previous aspect, further comprising purging the reactor with an inert gas prior to passing the aromatics-rich feed to the reactor.

Aspect 10. The process of any previous aspect, further comprising stirring the aromatics-rich feed in the reactor.

Aspect 11. The process of any previous aspect, wherein stirring is continuous throughout the duration of the process.

Aspect 12. The process of any previous aspect, wherein the aromatics-rich feed comprises: from 1 wt. % to 10 wt. % saturates; from 0.01 wt. % to 5 wt. % resins; and from 0 wt. % to 1 wt. % asphaltenes.

Aspect 13. The process of any previous aspect, wherein the aromatics-rich feed comprises from 85 wt. % to 95 wt. % carbon and from 5 wt. % to 15 wt. % hydrogen.

Aspect 14. The process of any previous aspect, wherein the aromatics-rich feed comprises less than 1 wt. % of a combination of sulfur, nitrogen, and oxygen.

Aspect 15. The process of any previous aspect, wherein the aromatics-rich feed has a hydrogen-to-carbon ratio of greater than 1.

Aspect 16. The process of any previous aspect, wherein the aromatics-rich feed comprises: from 4 wt. % to 8 wt. % saturates; from 90 wt. % to 95 wt. % aromatics; from 0.01 wt. % to 3 wt. % resins; and from 0 wt. % to 0.1 wt. % asphaltenes.

Aspect 17. The process of any previous aspect, wherein the mesophase pitch comprises: from 0 wt. % to 1 wt. % saturates; from 65 wt. % to 75 wt. % aromatics; from 10 wt. % to 20 wt. % resins; and from 10 wt. % to 20 wt. % asphaltenes.

Aspect 18. The process of any previous aspect, wherein the mesophase pitch has a softening point of from 150° C. to 350° C.

Aspect 19. The process of any previous aspect, wherein the temperature is greater than or equal to 400° C. and the duration is from 5 hours to 7 hours.

Aspect 20. The process of any previous aspect, wherein the temperature is greater than or equal to 450° C. and the duration is from 5 hours to 7 hours.

EXAMPLES

The various embodiments of the present disclosure will be further clarified by the following examples. The examples are illustrative in nature and should not be understood to limit the subject matter of the present disclosure.

Example 1—Sample Preparation

Light cycle oil (LCO) was used as the feedstock. The formation of mesophase pitch was carried out in a 0.1 Liter batch reactor equipped with a four-bladed flat turbine impeller. The reactor was purged with nitrogen for 10 minutes to ensure the pyrolysis conditions. The temperature of the reactor was gradually increased to reach the desired temperature through the reactor jacket. Testing was conducted under different temperature and pressure conditions, as indicated in Table 2.

Table 1 shows values for saturates, aromatics, resins, and asphaltenes (SARA) in the aromatics-rich feed used in Example 1. The aromatics-rich feed was separated into four chemical group classes, called the SARA fractions. The SARA analysis was divided into two stages. The first stage involved the precipitation and quantification of asphaltenes. The second stage involved open-column chromatographic separation of the de-asphalted oil into saturates, aromatics, and resins fractions following the ASTM D-2007 method.

TABLE 1

SARA analysis of the aromatics-rich feed

| | Saturates (wt. %) | Aromatics (wt. %) | Resins (wt. %) | Asphaltenes (wt. %) |
|---|---|---|---|---|
| Aromatics-rich feed | 5.37 | 93.1 | 1.39 | 0.01 |

Table 2 shows the elemental composition and hydrogen-to-carbon ratio of the aromatics-feed used in the examples.

TABLE 2

Composition of the aromatics-rich feed

| | |
|---|---|
| Carbon (wt. %) | 89 |
| Hydrogen (wt. %) | 10 |
| Nitrogen (wt. %) | 0.2 |
| Sulfur (wt. %) | 0.2 |
| Oxygen (wt. %) | 0.2 |
| H/C ratio | 1.3 |

Table 3 shows values for the reactor conditions and SARA analysis of the mesophase pitch examples.

TABLE 3

Reactor conditions and SARA analysis of mesophase pitch examples

| | Reactor Conditions | | | SARA Analysis | | | |
|---|---|---|---|---|---|---|---|
| Example | Temperature (° C.) | Pressure (bar) | Duration (hour) | Saturates (wt. %) | Aromatics (wt. %) | Resins (wt. %) | Asphaltenes (wt. %) |
| A | 375 | 20 | 5 | 5.37 | 93.12 | 1.39 | 0.02 |
| B | 375 | 20 | 8 | 2.51 | 92.77 | 4.34 | 0.22 |
| C | 375 | 25 | 5 | 2.19 | 89.98 | 7.32 | 0.39 |
| 1 | 450 | 20 | 5 | 0.01 | 69.96 | 15.84 | 14.11 |
| 2 | 450 | 20 | 7 | 0.0 | 71.05 | 15.72 | 13.05 |
| 3 | 450 | 30 | 5 | 0.0 | 70.17 | 14.88 | 14.94 |
| 4 | 450 | 40 | 7 | 0.0 | 70.80 | 14.40 | 14.77 |

As shown in Table 3, Examples 1~4 which were produced at a temperature of 450° C. have higher amounts of resins and asphaltenes than Comparative Examples A-C which were produced at a temperature of 375° C. Examples 1~4 also have lower amounts of aromatics than Comparative Examples A-C and higher amounts of resins and asphaltenes. This indicates that the aromatics in the aromatics-rich feed were polymerized in the reactor to produce resins and asphaltenes, and thus, produce mesophase pitch. For example, Comparative Example A was formed at 375° C., 20 bar and for 5 hours which resulted in a SARA analysis that is almost identical to the aromatics-rich feed. Example 1, which was formed at the same pressure and duration but at a temperature of 450° C. resulted in a great increase in the percentage of resins and asphaltenes and a great decrease in saturates and aromatics.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the appended claims should be taken as the sole representation of the breadth of the present disclosure and the corresponding scope of the various embodiments described in this disclosure. Further, it should be apparent to those skilled in the art that various modifications and variations can be made to the described embodiments without departing from the spirit and scope of the claimed subject matter. Thus it is intended that the specification cover the modifications and variations of the various described embodiments provided such modification and variations come within the scope of the appended claims and their equivalents.

For the purposes of describing and defining the present inventive technology it is noted that the terms "substantially" and "about" are utilized herein to represent the inherent degree of uncertainty that may be attributed to any quantitative comparison, value, measurement, or other representation. The terms "substantially" and "about" are also utilized herein to represent the degree by which a quantitative representation may vary from a stated reference without resulting in a change in the basic function of the subject matter at issue.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A process for making a mesophase pitch, the process comprising:

passing an aromatics-rich feed into a reactor, wherein:

the total amount of molecular oxygen and peroxides in the reactor is less than 1 mol. %;

the aromatics-rich feed comprises at least 80 wt. % aromatics selected from the group consisting of naphthalenes, acenaphthenes, acenaphthylenes, fluorenes, phenanthres, anthracenes, pyrenes, tetra-aromatics, penta-aromatics, or combinations thereof;

the aromatics-rich feed comprises less than 3 wt. % of a combination of sulfur, nitrogen, and oxygen; and subjecting the aromatics-rich feed to a temperature of greater than or equal to 350° C. and a pressure of from 20 bar to 40 bar for a duration of from 4 hours to 10 hours in the reactor to produce the mesophase pitch.

2. The process of claim 1, wherein the aromatics-rich feed is subjected to a temperature of greater than or equal to 400° C.

3. The process of claim 1, wherein the aromatics-rich feed is subjected to a temperature of greater than or equal to 450° C.

4. The process of claim 1, wherein the aromatics-rich feed comprises a cycle oil from a fluid catalytic cracking system.

5. The process of claim 1, wherein the mesophase pitch is made in a batch process.

6. The process of claim 1, wherein the duration is from 5 to 7 hours.

7. The process of claim 1, wherein:

the aromatics-rich feed comprises less than 5 wt. % resins; and the mesophase pitch comprises at least 10 wt. % resins.

8. The process of claim 1, wherein subjecting the aromatics-rich feed to the temperature of greater than or equal to 350° C. polymerizes the aromatics-rich feed in the reactor.

9. The process of claim 1, further comprising purging the reactor with an inert gas prior to passing the aromatics-rich feed to the reactor.

10. The process of claim 1, further comprising stirring the aromatics-rich feed in the reactor.

11. The process of claim 10, wherein stirring is continuous throughout the duration of the process.

12. The process of claim 1, wherein the aromatics-rich feed comprises:

from 1 wt. % to 10 wt. % saturates;

from 0.01 wt. % to 5 wt. % resins; and from 0 wt. % to 1 wt. % asphaltenes.

13. The process of claim 1, wherein the aromatics-rich feed comprises from 85 wt. % to 95 wt. % carbon and from 5 wt. % to 15 wt. % hydrogen.

14. The process of claim 1, wherein the aromatics-rich feed comprises less than 1 wt. % of a combination of sulfur, nitrogen, and oxygen.

15. The process of claim 1, wherein the aromatics-rich feed has a hydrogen-to-carbon ratio of greater than 1.

16. The process of claim 1, wherein the aromatics-rich feed comprises:

from 4 wt. % to 8 wt. % saturates;

from 90 wt. % to 95 wt. % aromatics;

from 0.01 wt. % to 3 wt. % resins; and from 0 wt. % to 0.1 wt. % asphaltenes.

17. The process of claim 1, wherein the mesophase pitch comprises:

from 0 wt. % to 1 wt. % saturates;

from 65 wt. % to 75 wt. % aromatics;

from 10 wt. % to 20 wt. % resins; and from 10 wt. % to 20 wt. % asphaltenes.

18. The process of claim 1, wherein the mesophase pitch has a softening point of from 150° C. to 350° C.

19. The process of claim 1, wherein the temperature is greater than or equal to 400° C. and the duration is from 5 hours to 7 hours.

20. The process of claim 1, wherein the temperature is greater than or equal to 450° C. and the duration is from 5 hours to 7 hours.

21. The process of claim 1, wherein the aromatics-rich feed comprises from 0 wt. % to 1 wt. % asphaltenes.

* * * * *